US005507590A

United States Patent [19]

Argandona

[11] Patent Number: 5,507,590

[45] Date of Patent: Apr. 16, 1996

[54] COVER ASSEMBLY FOR MANHOLES AND THE LIKE

[76] Inventor: Toby Argandona, 21221 Running Branch Rd., Diamond Bar, Calif. 91765

[21] Appl. No.: 286,133

[22] Filed: Aug. 4, 1994

[51] Int. Cl.[6] ..... E02D 29/14

[52] U.S. Cl. ..... 404/25; 49/386; 52/20

[58] Field of Search ..... 404/25, 26; 49/386; 52/19, 20

[56] References Cited

U.S. PATENT DOCUMENTS 3,455,059 7/1969 Evans, III ..... 404/25 X

FOREIGN PATENT DOCUMENTS 507708 10/1992 European Pat. Off. ..... 404/25

4208453 9/1993 Germany ..... 404/25

*Primary Examiner*—William P. Neuder

*Attorney, Agent, or Firm*—Boniard I. Brown

[57] ABSTRACT

A cover assembly for manholes and the like has a hinged cover which is urged closed by gravity and open by an opposing bias force acting between the cover and cover base in such manner as to reduce the force required to open a relatively heavy cover whose weight exceeds the maximum single person lifting weight permitted by OSHA and union regulations to a value equal to or less than such maximum lifting weight. A manually releasable latch prevents uncontrolled closure of the cover by gravity in the event of failure of the bias force.

12 Claims, 1 Drawing Sheet

COVER ASSEMBLY FOR MANHOLES AND THE LIKE

BACKGROUND OF THE INVENTION

FIELD OF THE INVENTION

This invention relates generally to covers for access openings and more particularly to an improved cover assembly for manholes and the like.

DISCUSSION OF THE PRIOR ART

It will become evident as the description proceeds that the improved cover assembly of this invention may be used for a variety of purposes. The cover assembly is primarily intended for use as a manhole cover assembly, however, and will be described in the context of this use.

Broadly defined, a manhole is an access opening through which persons and/or equipment may pass to and from an enclosed space which may be the interior of a sewer, equipment well, boiler, pipe, conduit, drain, tank or the like. The manhole is closed by what is commonly referred to as a manhole cover. Perhaps the most familiar type of manhole is a circular opening in a street, driveway floor or the like which opens Lo an underlying sewer or equipment well. The cover assembly of this invention is intended primarily for use as a manhole cover assembly for closing a manhole in the floor or driveway of a gasoline service station or the like which opens to an underlying well containing tank fill couplings, pumps, and/or other service station equipment. A typical manhole cover for manholes of this kind is a cast iron disc which may weigh up to 195 to 200 pounds, depending upon the size of the cover.

Manhole covers of this kind are difficult to lift and to move to and from their manholes. Moreover, OSHA regulations, union rules, and other workplace regulations require that a person shall be required to lift no more than 70 pounds. At least two persons are thus required to handle manhole covers of the kind referred to above. The need to have two persons available to handle manhole covers, of course, is inconvenient and costly. Moreover, it is difficult for two persons to efficiently coordinate their efforts in such a way as to equally share the weight of a manhole cover. There is in addition the ever-present danger that one or both persons may lose their grip on the cover in which case one or both persons may incur serious injury. Further, it is difficult for two men in lifting and handling a heavy cover to prevent an O-ring seal from falling out of its proper position and thus not providing a water-tight seal. The seal of the invention cannot be thus disturbed. Accordingly, there is a definite need for an improved cover assembly for manholes and other similar relatively large access openings which is not subject to the above handling difficulties and dangers.

SUMMARY OF THE INVENTION

This invention provides such an improved cover assembly of the class described. The cover assembly includes a base having an access opening surrounded by a cover seat, and a cover mounted on the base for movement between open and closed positions. In its closed position the cover engages the cover seat and closes the base opening. In its open position, the cover permits unobstructed passage of persons and/or equipment through the opening. The cover assembly has a normal position in which gravity urges the cover in one direction and toward one of its positions. Accordingly, movement of the cover to its other position occurs against the force of gravity and in the case of a large cover requires a force exceeding the maximum lifting force permitted by the OSHA and union regulations referred to earlier.

According to one feature of this invention, the cover assembly includes cover biasing means acting between the cover and base for urging the cover against the force of gravity with a bias force such that the cover may be easily moved against the force of gravity by a single person acting well within the OSHA and union regulations. According to another feature of the invention, the cover assembly includes manually releasable cover restraining means acting between the cover and base for preventing sudden uncontrolled movement of the cover by the force of gravity in the event of failure of the cover biasing means. An additional feature of the invention resides in a unique hinge means connecting the cover and base for swinging movement of the cover between its open and closed positions. When the cover is open, the cover, the cover biasing means, and the cover restraining means are disposed to permit relatively unobstructed passage of persons and/or equipment through the base.

The presently preferred embodiment of the improved cover assembly described herein is a manhole cover assembly for industrial applications. etc., and for service station equipment wells of the kind mentioned earlier. The base of this preferred manhold cover assembly is a generally annular base member having normally upper and lower ends and a circular opening extending coaxially through the base member. The assembly cover is a disc-shaped cover member hinged to one side of the upper end of the base for generally vertical swinging movement between its open and closed positions. In its closed position, the cover is coaxially disposed on the upper end of the base in seating contact with a cover seat about the upper end of the base opening. Gravity urges the cover closed. The cover hinge means includes coacting hinge parts on the cover and base which are located within a hinge well at one side of the upper base base end and are easily separable to permit removal of the cover from the base and removal of water and debris from the hinge well.

The cover biasing means of the preferred cover assembly is a cover biasing device similar to a gas shock absorber connected between the cover and base. This cover biasing device includes a cylinder containing a plunger and a compressed gas which urges the cylinder and plunger apart to urge the cover open against the force of gravity on the cover. The opening force exerted on the cover by the biasing device is less than the gravitational force tending to close the cover by an amount such that the net gravitational closing force on the cover (which equals the force required to open the cover) is within the permissible lifting force range set forth in the OSHA and union regulations referred to earlier. The cover restraining means of the preferred manhole cover assembly is a gravity actuated latch which prevents accidental uncontrolled closure of the cover by the force of gravity in the event the cover biasing device fails. This latch is manually releasable to permit normal closing of the cover by a person. The cover, the cover biasing device, and the cover restraining latch are arranged so as to not obstruct free passage of persons and/or equipment through the base when the cover is open.

DESCRIPTION OF THE PREFERRED EMBODIMENTS

Figure 5:
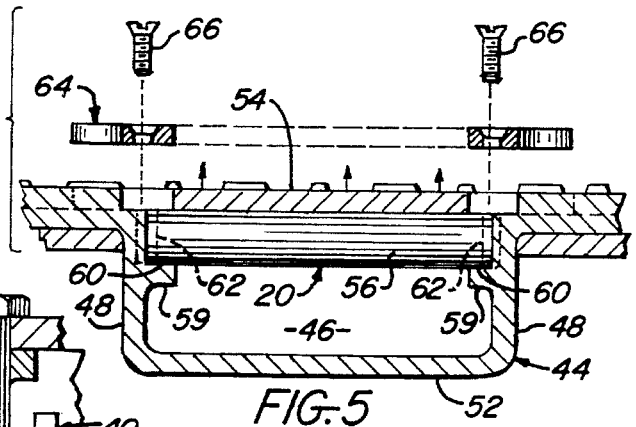
FIG. 5 is a section taken on line 5—5 in FIG. 4.
Figure 6:
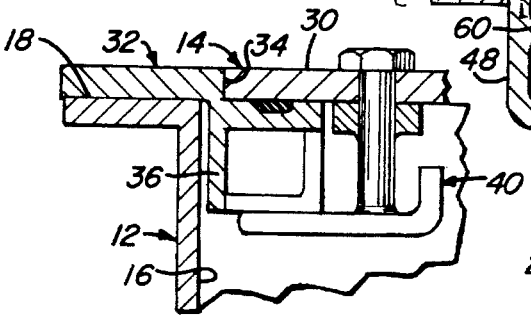
FIG. 6 is an enlarged section taken on line 6—6 in FIG. 3.

Turning now to these drawings, the illustrated cover assembly 10 includes a base 12 and a cover 14. Extending through the base 12 is an access opening 16 circumferentially surrounded at one end by an annular cover seat 18 on the adjacent end of the base. Cover 14 is connected to this end of the base 12 by novel hinge means 20 according to the invention which supports the cover on the base for movement of the cover between its open position of FIGS. 1 and 2 and its closed position of FIGS. 4–6. In its closed position, the cover contacts the cover seat 18 and closes the adjacent end of the base opening 16. In its open position, the covey is spaced from the cover seat 18 and uncovers the adjacent end of the base opening in such a way as to not obstruct passage of persons or equipment through the opening.

The cover assembly 10 has a normal position in which gravity urges the cover 14 in one direction and toward one of its open and closed position. This invention is concerned with cover assemblies of the kind illustrated having a relatively heavy cover such that movement of the cover against the force of gravity by one person is difficult or impossible and requires a force greater than that permitted by the OSHA and union regulations referred to earlier. It will be recalled that these regulations dictate that a person shall not be required to lift more than 60 pounds. According to one feature of the invention, the cover assembly 10 includes a covey biasing means 22 which acts between the base 12 and cover 14 and urges the cover in a direction opposite the direction of the gravitational force on the cover and with a bias force such that the net force required to move the cover against the gravitational force is within the requirements of the OSHA and union regulations. According to another feature of the invention, the cover assembly 10 includes manually releasable cover restraining means 24 acting between the base 12 and cover 14 for preventing sudden uncontrolled movement of the cover by the force of gravity in the event of failure of the cover biasing means 22. When the cover 14 is open, the cover, cover biasing means 22, and the covet restraining means 24 are disposed in close proximity to one another at one side of the base opening 16 to permit relatively unobstructed passage of persons and/or equipment through the base opening.

The particular cover assembly 10 illustrated in the drawings is a manhole cover assembly for a service station equipment well of the kind mentioned earlier. The base 12 of the cover assembly has a short tubular body 26 whose normal position is the generally vertical position shown in the drawings so that the body has normally upper and lower ends. Circumferentially surrounding the upper end of the body in a transverse plane of the body is an outwardly directed flange 28 which provides the cover seat 18.

Figure 4:
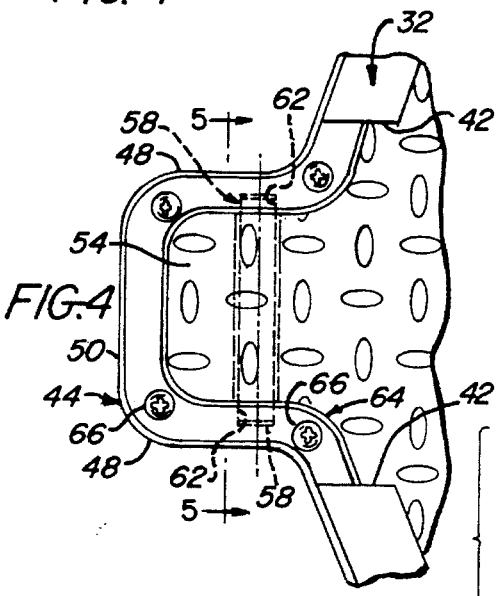
FIG. 4 is an enlarged detail view taken on line 4—4 in FIG. 3.
Figure 3:
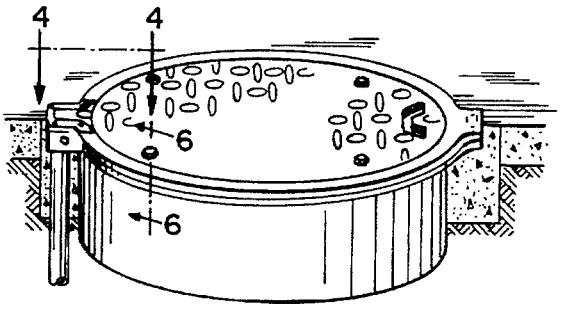
FIG. 3 is perspective view of the cover assembly in its closed position.

The cover 14 of the cover assembly includes a central flat disc portion 30 circumferentially surrounded by a split ring 32, This ring has a coaxial annular recess 34 in its normally upper side in which the periphery of the disc portion 30 seats with the upper surface of the disc portion flush with the upper surface of the ring, The ring 32 has a coaxial annular shoulder 36 of rectangular cross-section sealed to the underside of the cover disc portion 30 and an annular flange 38 coplanar with and extending radially out from the edge of the cover disc portion 30. The COVET disc portion 30 and ring 32 are rigidly joined by clamps 40 secured to the under side of and spaced circumferentially about the disc portion. Ring 32 has spaced split ends 42 which are spaced circumferentially of the cover to form a gap between the ring ends, as shown in FIG. 4. Integral with and extending across the under side of the cover disc portion are reinforcing ribs 43.

Integral with and extending radially out from one side of the upper end of the base 12 is a generally rectangular enlargement 44 forming a hinge well 46 which opens upwardly through the upper end of the base and radially inward to the central opening 16 through the base. The well 46 has end walls 48, an outer side wall 50, and a bottom wall 52. The upper edges of the walls 48, 50 are coplanar with the upper end of the base flange 28.

The central disc portion 30 of the cover 14 has a radially projecting tongue 54 radially aligned with the gap between the split ends 42 of the cover ring 32. When the cover is closed, this tongue extends outwardly over the hinge well 46, as shown in FIGS. 3–6. During rotation of the cover to its open position, the tongue rotates downwardly into the well, as explained below.

The cover hinge means 20 comprises a hinge pin 56 welded or otherwise rigidly joined to the under side of the cover tongue 54. This hinge pin is located about midway between the radially inner and outer ends of the tongue and extends perpendicular to a radius of the cover disc portion 30 bisecting the cover tongue. The length of the hinge pin is greater than the width of the tongue so that the ends of the pin extend substantially equal distances beyond the radial edges of the tongue, as shown. The projecting ends of the hinge pin 56 engage rotatably in normally vertical slots 58 (FIG. 4) which enter the inner confronting sides of bosses 59 on the hinge well end walls 48. As may be best observed in FIG. 5, these slots open upwardly through the upper edges of the bosses. The hinge pin slots 58 have bottom walls 60 which rotatably support the ends of the hinge pin 56 in the vertical direction and side walls 62 which confine the hinge pin ends laterally.

Extending between the split ends 42 of the cover ring 32 along the upper edges of the hinge well end and side walls 48, 50 is a generally U-shaped hinge pin retaining strap 64. This retaining strap is releasably secured by screws 66 to the upper edges of the walls 48, 50. As may be best seen in FIGS. 4 and 5, the strap 64 projects laterally inward beyond the inner sides of the walls 48, 50 and overlies the open upper ends of the hinge pin slots 58 to retain the ends of the hinge pin 56 in the slots. The hinge pin 56, the hinge pin slots 58, and the retaining strap 64 together constitutes the cover hinge means 20.

Figure 1:
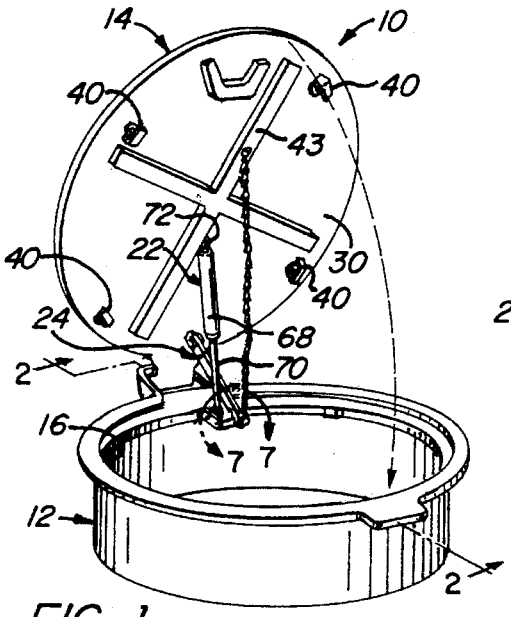
FIG. 1 is perspective view of a presently preferred manhole cover assembly according to the invention.
Figure 2:
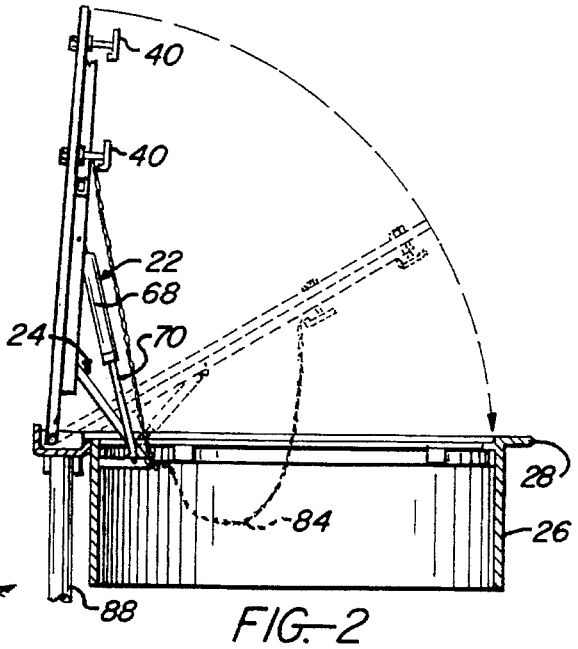
FIG. 2 is a side elevation of the cover assembly showing its cover in its full open position in solid lines and in a partially open/closed position in broken lines.

The edge of the cover tongue 54 extends from one split end 42 of the cover ring 32 to its other split end 42 with a curvature that conforms closely to the curvature of the laterally inner edge of the hinge pin retaining strap 64 and with a slight spacing, as the cover assembly is viewed in FIG. 4, between the inner retaining strap edge and the tongue edge to permit swinging of the cover 14 between its open position of FIGS. 1 and 2 and its closed position of FIGS. 3–6. When the cover is closed, the flange 38 of the cover ring 32 rests on the cover seat 18 of the base 12, the cover ring shoulder 36 is positioned within the upper end of the base opening 16, and the cover tongue 54 projects radially outward over the open upper side of the hinge well 46. During opening and closing movement of the cover 14, the cover tongue rotates into and from the hinge well 46. The cover 14 is removable from the base 12 to permit cleaning of leaves and debris from the hinge well 46 by removing the hinge pin retaining strap 64 and lifting the cover to remove the cover hinge pin 56 from the hinge well slots 58.

In the preferred cover assembly 10 illustrated, the cover 14 is movable up and down between its open and closed positions so that gravity urges the cover closed, The cover biasing means 22 comprises a cover biasing device similar to a gas shock absorber, This biasing device acts between the base 12 and cover 14 to urge the cover open against the force of gravity. Cover biasing device 22 includes a cylinder member 68 containing a movable plunger member 70 and a compressed gas which is confined between the plunger member and cylinder member and urges these members axially apart. The free end of the cylinder member 68 is releasably pivotally attached to a bracket 72 rigidly joined to the underside of the cover 14 near its center. The plunger member 70 is pivotally attached to a bracket 72 rigidly joined to inner wall of the base opening 30 adjacent the upper end of this opening and immediately radially inward of the cover hinge means 20.

The cover biasing device 22 is connected between the base 12 and the cover 14 in such manner that when the cover assembly 10 occupies its normal position illustrated in the drawings, the gas pressure in the biasing device urges the cover 14 toward its open position of FIGS. 1 and 2. In this open position, the cover is generally upright in its edgewise direction at one side of the base 12 so that gravity exerts very little if any closing force on the cover. The biasing device 22 then extends from the center of the cover to a position at the upper end of the base close to the cover hinge means 20 so that neither the cover nor the biasing device obstructs passage of persons or equipment through the base opening 30. During movement of the cover to its closed position of FIGS. 3–6, the gravitational closing force on the cover increases, and the gas within the biasing device 22 is further compressed to increase the opening force exerted on the cover by the cover biasing device 22 as the gravitational force on the cover increases. Thus, the biasing device 22 supports some portion of the weight of the cover 14 during opening and closing of the cover. The portion of the cover weight supported by the biasing device will depend upon the pressure of the gas within the device when the cover is full open. According to this invention, this gas pressure is set so that the maximum force required to lift the cover from its closed position to its open position, and hence the force required to support the cover during closure of the cover is no greater than that (60 pounds) dictated by the OSHA and union regulations mentioned earlier. The cover 14 of the present cover assembly may thus be opened by one person without breaching the OSHA and union regulations. While the described gas filled cover biasing device is the preferred biasing device, a spring biasing device may be used.

The cover assembly 10 includes the cover restraining device 24 to prevent uncontrolled closure of the cover 14 in the event of failure of the cover biasing device 22. The illustrated cover restraining device comprises a gravity actuated latch including a latch arm 76 pivoted at one end on the underside of the cover 14 a distance above the cover hinge means 20 and on a pivot axis substantially parallel to the cover pivot axis. Entering the lower edge of the latch arm 76 and inclined toward the pivoted end of the arm are a series of cutouts or notches 78. The free end of the latch arm rests on the cross arm 80 of a keeper 82 rigidly secured to the inner wall of the base opening 30 at the upper end of the opening directly opposite the cover hinge means 20. During opening of the cover 14, the latch arm 76 slides upwardly across the keeper cross arm 80. The latch arm notch 78 nearest the free end of the latch arm is preferably located so that it either engages the keeper cross arm 80 when the cover 14 is wide open to positively hold the cover wide open or engages the keeper arm during initial closing movement of the cover to prevent further closing movement of the cover in the event that the cover biasing device 22 fails when the cover is open. The remaining notches 78 are spaced along the latch arm 76 to engage the keeper cross arm 80 and thereby arrest the cover 14 at various positions in the event of failure of the biasing device at different positions of the cover during opening or closing of the cover. Connected between the free end of the latch arm 76 and the underside of the cover 14 is chain which may be pulled to release the latch arm from the keeper 82 in order to close the cover.

Figure 7:
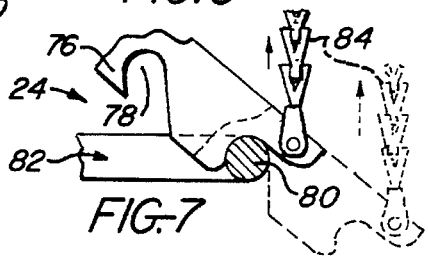
FIG. 7 is an enlargement of the area enclosed by the circular arrow 7—7 in FIG. 1.

From the preceding description, it will be understood that the cover restraining means 24 comprises a manually releasable latch including coacting latch parts 76, 82 on the cover 14 and base 12, respectively, and having a normal automatic latching state in which the latch parts contact one another, as in FIG. 7, and a released state in which the latch parts are disengaged by pulling on the chain 84. The latch parts 76, 82 are disposed for engagement in at least one position of the cover 14 other than its closed position to arrest closing movement of the cover during closing of said cover while the latch 24 occupies its latching state.

The covet assembly 10 is intended to be installed in a service station apron or the like with the cover 14 flush with the surface and with the opening 16 of the base 12 opening to an underground space or well containing equipment such as valves, pumps, and the like. When open, the cover assembly provides unobstructed access to the space. The cover assembly can also be used for any of the other uses mentioned earlier. If desired, a drain pipe 88 may extend down from the bottom wall 52 of the hinge well 46 for draining water from the well.

The inventor claims:

1. A cover assembly comprising:

a base having opposite ends and an access opening extending through said ends, a cover, means mounting said cover on said base for movement of said cover in opposite directions between a closed position in which said cover closes said opening and an open position and in such manner that gravity urges said cover in one of said directions and toward a certain one of said open and closed positions, biasing means acting between said cover and base urging said cover in the other direction against the gravitational force on said cover, manually releasable cover restraining means connected between said cover and base for preventing uncontrolled movement of said cover in said one direction by gravity in the event of failure of said biasing means, and wherein said cover restraining means comprises a manually releasable latch including coacting latch parts on said cover and base, respectively, which are releasably engagable in latching relation in a first latching position of said cover to secure the cover against movement in said one direction beyond said latching position, and which latch parts are releasably engagable in latching relation in a second latching position of said cover between said first latching position and said certain one of said open and closed positions to secure the cover against movement in said one direction beyond said second latching position, and latch release means for disengaging said latch parts at each said latching position to permit movement of said cover in said one direction beyond the respective latching position.

2. A cover assembly according to claim 1, wherein:

movement of said cover in said one direction occurs toward said closed position, and said biasing means urges said cover toward its open position.

3. A cover assembly according to claim 1 wherein:

one of said latch parts has a longitudinal edge which normally contacts and slides endwise across the other latch part during opening and closing movement of said cover, and a plurality of notches spaced along and opening through said edge, said other latch part is engagable in said notches in said cover latching positions, respectively, to secure said cover against movement in said one direction beyond the respective latching position, and said latch release means comprises means for disengaging said other latch part from a notch in said one latch part.

4. A cover assembly according to claim 1 wherein:

one of said latch parts comprises an elongate latch arm pivoted at one end on said cover and the other latch part comprises a keeper on said base, said latch arm has a longitudinal edge which is normally retained by gravity in contact with said keeper and slides endwise across said keeper during opening and closing movement of said cover, and a plurality of notches spaced along and opening through said edge, said keeper is engagable in said latch arm notches in said cover latching positions, respectively, to secure said cover against movement in said one direction beyond the respective latching position, and said latch release means comprises means for disengaging said latch arm from said keeper to disengage said keeper from a notch in said latch arm.

5. A cover assembly comprising:

a base having opposite ends, an access opening extending through said ends, and a cover seat circumferentially surrounding said opening at one of said ends, a cover, hinge means mounting said cover on said one end of said base for pivotal movement of said cover between a closed position in which said cover engages said cover seat and closes the adjacent end of said opening and an open position spaced from said seat in which said cover uncovers said opening, and wherein said base includes a formation at one side of said one end of said base forming a hinge well opening inwardly to said adjacent end of said base opening and opening through said one end of said base and having confronting end walls spaced circumferentially of said base, said cover includes a radially projecting tongue which overlies said well when said cover occupies its closed position, said hinge means comprises slots in the confronting sides of said well end walls which open laterally toward one another and have open ends opening through said one end of said base, a hinge pin within said well rigidly joined to the underside of said cover tongue and having ends rotatably positioned in said slots, and hinge pin retaining means releasably secured to said one end of said base and overlying the open ends of said slots to retain said hinge pin ends in said slots, said cover assembly has a normal position such that gravity urges said cover toward its closed position, and said cover assembly includes biasing means acting between said base and cover urging said cover open against the gravitational force on said cover, and manually releasable cover restraining means connected between said base and cover for preventing uncontrolled closing movement of said cover by gravity in the event of failure of said biasing means.

6. A cover assembly according to claim 5 wherein:

said biasing means comprises a biasing device connected between said base and cover and including a cylinder, a plunger movable in said cylinder, and a gas under pressure within said cylinder urging said cylinder and plunger axially apart.

7. A cover assembly according to claim 6 wherein:

said cover restraining means comprises a manually releasable latch including coacting latch parts on said cover and base and having a normal automatic latching state and a released state, and said latch parts are disposed for engagement in at least one position of said cover other than said closed position to arrest closing movement of said cover during closing movement of said cover while said latch occupies said latching state.

8. A cover assembly comprising:

a base having opposite ends, an access opening extending through said ends, and a cover seat circumferentially surrounding said opening at one of said ends, a cover, hinge means mounting said cover on said one end of said base for pivotal movement of said cover between a closed position in which said cover engages said cover seat and closes the adjacent end of said opening and an open position spaced from said seat in which said cover uncovers said opening, and wherein said base includes a formation at one side of said one end of said base forming a hinge well opening inwardly to said adjacent end of said base opening and through said one end of said base and bounded by confronting end walls spaced circumferentially of said base, said cover includes a radially projecting tongue which overlies said well when said cover occupies its closed position, said hinge means comprises slots in the confronting sides of said well end walls which open laterally toward one another and have open ends opening through said one end of said base, a hinge pin within said well rigidly joined to the underside of said cover tongue and having ends rotatably positioned in said slots, and hinge pin retaining means releasably secured to said one end of said base and overlying the open ends of said slots to retain said hinge pin ends in said slots, said cover seat comprises a flange about said one end of said base, and said cover comprises a central disc portion having normally upper and lower sides, a ring about the edge of said disc portion having a normally upper side containing a circumferential recess receiving the periphery of said disc portion, a circumferential flange radially outward of said recess and coplanar with said disc portion, an annular shoulder seating against the lower side of said disc portion, and means securing said ring to said disc portion.

9. A cover assembly comprising:

a base having normally upper and lower ends, an access opening extending through said ends, a cover seat circumferentially surrounding said opening at said upper end of the base, and a hinge well opening upwardly through the upper end of said base and inwardly to said base opening and having confronting end walls spaced circumferentially of said base which face one another and have upper edges at said upper end of said base, a cover having a radially projecting tongue extending edgewise of the cover into said well between said well end walls, cooperating hinge means on said cover tongue and well end walls mounting said cover on said upper end of said base for pivotal movement of said cover between a closed position in which said cover engages said cover seat and closes said base opening and an open position spaced from said seat in which said cover fully uncovers said base opening, and wherein said cover tongue has a normally lower surface, said cooperating hinge means comprise slots in said well end walls having open upper ends opening upwardly through said upper end wall edges and closed lower ends, and said slots extend endwise of said base along the entire length of said slots between said slot ends, a hinge pin seating against and fixed to said lower surface of said cover tongue and having ends projecting beyond edges of said tongue into said slots, and retaining means overlying said upper ends of said slots and secured to said upper end wall edges.

10. A cover assembly according to claim 9 including:

cover biasing means connected between said base and cover for urging said cover open.

11. A cover assembly according to claim 10 wherein:

said cover biasing means comprises a biasing device including one end connected to said cover, an opposite end connected to said base within said base opening and directly adjacent said well, and means for urging said biasing device ends away from one another.

12. A cover assembly comprising:

a base having opposite ends and an access opening extending through said ends, a cover, means mounting said cover on said base for movement of said cover in opposite directions between a closed position in which said cover closes said opening and an open position and in such manner that gravity urges said cover in one of said directions and toward a certain one of said open and closed positions, biasing means acting between said cover and base urging said cover in the other direction against the gravitational force on said cover, manually releasable cover restraining means connected between said cover and base for preventing uncontrolled movement of said cover in said one direction by gravity in the event of failure of said biasing means, and wherein said cover restraining means comprises a manually releasable latch including coacting latch parts on said cover and base, respectively, which are releasably engagable in latching relation in a latching position of said cover between said open and closed positions to secure the cover against movement in said one direction beyond said latching position, and latch release means for disengaging said latch parts at said latching position to permit movement of said cover in said one direction beyond said latching position.

* * * * *